United States Patent [19]

Heydner

[11] Patent Number: 4,620,735

[45] Date of Patent: Nov. 4, 1986

[54] DOOR-BOLTING DEVICE FOR ELECTRICAL APPLIANCES

[75] Inventor: Konrad Heydner, Altdorf, Fed. Rep. of Germany

[73] Assignee: Ellenberger & Poensgen GmbH, Altdorf, Fed. Rep. of Germany

[21] Appl. No.: 743,704

[22] Filed: Jun. 11, 1985

[30] Foreign Application Priority Data

Aug. 18, 1984 [DE] Fed. Rep. of Germany ..... 3430414

[51] Int. Cl.[4] ..... E05B 47/00

[52] U.S. Cl. ..... 292/144; 70/275; 70/277; 70/DIG. 48; 200/50 A; 200/61.64; 200/83 WM; 292/DIG. 69

[58] Field of Search ..... 70/DIG. 30, DIG. 48, 70/DIG. 50, 275, 277, 281; 292/144, 201, DIG. 69; 335/77; 200/61.62, 61.64, 50 A, 83 WM; 92/5 R, 5 L

[56] References Cited

U.S. PATENT DOCUMENTS

| | | | |
|---|---|---|---|
| 3,549,838 | 12/1970 | Waskowsky | 200/83 WM |
| 4,032,180 | 6/1977 | Pohl | 292/DIG. 69 X |
| 4,262,945 | 4/1981 | Paulson | 292/DIG. 69 X |

FOREIGN PATENT DOCUMENTS

| | | | |
|---|---|---|---|
| 2254595 | 7/1973 | Fed. Rep. of Germany | 292/DIG. 69 |
| 3214436 | 10/1983 | Fed. Rep. of Germany . | |
| 19959 | of 1915 | United Kingdom | 292/144 |

*Primary Examiner*—Alexander Grosz
*Assistant Examiner*—Lloyd A. Gall
*Attorney, Agent, or Firm*—Spencer & Frank

[57] ABSTRACT

A door-bolting device for electrical appliances, in particular washing machines, comprises a longitudinally displaceable slide bolt having a locking opening for a door-locking hook, one or two bolting openings for engagement by a bolting rod, and a lock-down recess. In open position, the free end of a signal contact spring enters this lock-down recess; this spring and a fixed contactor member opposite and parallel with the former constitute a signal contact unit. During bolting operation, a signal contact is made in this unit and controls a bolt-actuating relay comprising a magnet yoke, a coil, a core and a double-armed magnet armature lever. The free end of a bolting arm of the latter constitutes a bearing for the bolting rod which is displaced, during bolting operation, by a swivel motion of the lever. The end of a main contact arm of the same lever serves as bearing for a connecting shaft which is fastened to a diaphragm subdividing a pressure chamber. The latter is connected with a pressure-equalizing chamber fillable with a fluid medium such as water via a supply duct. The connecting shaft end remote from the diaphragm exerts during bolting displacement increasing pressure on a main contactor spring which makes, together with a fixed main contactor member, a main contact for switching on the appliance.

12 Claims, 2 Drawing Figures

DOOR-BOLTING DEVICE FOR ELECTRICAL APPLIANCES

BACKGROUND OF THE INVENTION

This invention relates to a door-bolting device for electrical appliances, and in particular for the doors of washing machines. More particularly, the invention relates to a door-bolting device having an instant bolting and a delayed unbolting action combined with monitoring the water level in the appliance.

A known door-bolting device for the above-stated purpose comprises (a) a housing; and (b) a slide bolt having several through-holes (openings molded, punched or bored) therein and being longitudinally displaceable in a longitudinal guiding groove provided in one face of a main wall of the housing;

one of the through-holes being a locking aperture associated with, and adapted for being entered by, a door-locking hook being connected with the door to be bolted, at least one of the other through-holes being a bolting opening adapted for being penetrated by a bolting rod so as to block the movement of the slide bolt when the door-bolting device is in bolted position; and the slide bolt comprising a lock-down recess being in parallel and staggered relationship with the through-holes in the slide bolt.

Such bolting devices have been described, for instance, in the German Offenlegungsschrift No. 32 14 436. They are bimetal-controlled devices being adapted for delayed bolting of the door of an electrical appliance as well as delayed unbolting of the same. No simultaneous monitoring of the water level in the appliance is provided for when using these known door-bolting devices, for instance, in washing machines.

OBJECT AND SUMMARY OF THE INVENTION

The invention strives to solve the problem of providing a door-bolting device for electrical appliances, in particular for washing machines, which will guarantee an instant bolting and a delaying unbolting of the appliance door, with a simultaneous monitoring of the water level in the appliance.

This problem is solved, in accordance with the invention, by a bolting device comprising the above-listed features (a) and (b) as well as, in combination therewith, the following novel features:

(c) a signal contact until comprising a fixed signal contactor member and a signal contactor spring located opposite the former member;

said signal contactor spring being adapted for engaging the lock-down recess of the slide bolt when the door-bolting device is in open position, and for disengaging the lock-down recess by the bolting movement of the said slide bolt, whereby, in the bolted position, the signal contactor unit makes contact due to a spatial displacement of the signal contactor spring;

(d) a bolt-actuating relay comprising magnet means with a pole face and comprising a magnet yoke an electro-magnetic coil, a core and a magnet armature lever being disposed laterally besides the magnet pole face and having a bolting arm and a main contact arm, whereof the bolting arm has a free end constituting a bearing for the bolting rod which latter is displaceably guided in the longitudinal groove in the housing;

(e) a pressure chamber;

(f) a diaphragm dividing the interior of the chamber;

(g) a pressure chamber lid having a lid opening;

(h) a connecting member, in particular a connecting shaft, being axially displaceably guided in, and snugly filling the interior of, the lid opening, the connecting shaft or the like member being fastened to the diaphragm, and the main contact arm having a free end constituting a bearing for the connecting member;

(i) a pressure-equalizing chamber;

(j) a fluid-conducting channel connecting the pressure-equalizing chamber with the pressure chamber, and a supply duct adapted for feeding a fluid medium from the outside into the pressure-equalizing chamber; and (k) an adjustable main contactor unit comprising a fixed main contactor member and a main contactor spring adapted for making electrical contact with the fixed main contactor member at a main contact point therebetween, and the connecting shaft or the like member, which has one of its ends face away from the diaphragm, increasingly urges the main contactor spring, against its spring bias, into contact with the main contactor member at the main contact point, during each bolting operation of the device according to the invention.

In the "open" or unbolted position of the door-bolting device according to the invention, the lock-down recess in the slide bolt, which recess extends parallel with the through-holes of the bolt, is engaged by the signal contactor spring which, together with the fixed signal contactor member disposed parallel with, and opposite the former, forms the signal contact unit.

During the bolting movement which is controlled by the door-locking hook mentioned under (b), supra, the signal contactor spring is moved out of engagement with the lock-down recess and, by its ensuing spatial displacement, makes contact in the signal contact unit. Thereby, the coil in the electromagnetic bolting relay is energized directly via a programming control circuit, so that the bolting arm of the magnet armature lever is attracted by the relay core. At the free end of the bolting arm of the lever, there is borne the bolting rod which moves, due to the lever movement, into and through a through-hole in the slide bolt, thereby blocking movement of the latter. This guarantees a bolting free from delay, of the door-bolting device according to the invention.

The other, main contact arm of the magnet armature lever constitutes the bearing for the connecting shaft or the like member which completely fills the lid opening of the pressure chamber in which opening the shaft is guided for longitudinal displacement; one end of the shaft is fastened, in the interior of the pressure chamber, to the diaphragm which subdivides the pressure chamber interior.

During bolting, the other end of the connecting shaft, facing away from the diaphragm, exerts increasing pressure on the main contactor spring against the bias of the latter. By the main contactor spring making contact, during the bolting movement, with the fixed main contactor member at the main contact point, the electrical appliance is being switched on practically instantly.

The pressure-equalizing chamber can be filled via the supply duct with, for instance, water. This construction of the door-bolting device guarantees a delayed unbolting as well as a simultaneous monitoring of the water level. When the electrical appliance is switched off, the bolt-actuating relay wil no longer attract the magnet armature lever. The restoring force of the main contactor spring causes an unbolting movement which is, however, delayed by the counter-pressure on the diaphragm building up in the pressure chamber. The delay time can be determined by an appropriate type of construction of the diaphragm and the pressure chamber system. It is thus possible to protect, for instance, the washing drum discharge of a washing machine against premature access.

The embodiment of a pressure chamber system described in items (e) to (k), supra, enables monitoring of the water level in a washing machine, a spin dryer, a dish washer or the like appliances. When the water level in such type of appliance exceeds a determined height, then the lower space of the pressure chamber will be filled with water via the fluid-conducting channel, the pressure-equalizing chamber and the supply duct. As a liquid in a pressure chamber builds up a substantially higher counter-pressure than a gas, the door-bolting device can be unbolted only very slowly or not at all. It will, therefore, be possible to open the door of the electrical appliance only after the water level in the same has dropped below a determined limit level and the pressure chamber has been emptied via the fluid conducting channel, the pressure-equalizing chamber and the supply duct. The emptying time can be determined by the length and the cross-sectional area of the fluid-conducting channel. This embodiment of the door-bolting device according to the invention prevents water from pouring from such appliances as washing machines by a premature opening of the appliance door.

In a preferred embodiment of the door-bolting device according to the invention, the housing comprises a housing part surrounding the magnet core and the magnet yoke on the sides thereof opposite the bolting rod, and the magnet armature mature lever is rotatably supported on the housing part. The two arms of the magnet armature lever preferably enclose an obtuse angle the apex of which faces toward the bolt-actuating relay. These features permit provision of a small spacing of the magnet armature lever from the magnet core, and at the same time adequate leverage for the bolting rod and the connecting shaft or the like member, thereby guaranteeing a quick and safe bolting action.

In spite of the not exactly small number of building elements required in the device, a narrow, flat design thereof is thus made possible, and a safe functioning is guaranteed by an embodiment comprising one or both of the features that, firstly, the directions of movement of the magnet armature lever, the bolting rod, the slide bolt, the connecting shaft and the two contactor springs, the signal and the main one, extend in a common plane, and, secondly, that the longitudinal axes of the slide bolt, the two aforesaid contactor springs, the diaphragm and the magnet armature lever all extend substantially parallel with each other.

According to another feature of the invention, the main contactor unit comprises a pressure spring adapted for exerting increasingly pressure on the main contact arm of the magnet armature lever during the bolting operation, thereby opposing a pivotal movement of the latter; the action of this pressure spring thereby aids the restoring force of the main contactor spring.

In accordance with a further feature of the invention, the housing comprises a second housing part and a screw therein bearing the pressure spring and being adapted for adjusting the restoring force thereof acting upon the main contact arm of the magnet armature lever. The resulting adjustability of the pressure spring force offers a simple way of adapting the said force and, together therewith, the desired delay time in unbolting the appliance door. It is thus possible to adapt the door-bolting device in a simple and quick manner to the required condition for the practical use of the electrical appliance.

The diaphragm can comprise stiffening bars or ribs being attachable to the connecting shaft or the like member so as to be located in a central, radially internal region of the diaphragm. The stiffening bars, ribs or plates guarantee a safe mounting of the diaphragm on the connecting shaft. Moreover, they contribute to a greater stability of the diaphragm and protect it against damage by tearing or splitting.

The longitudinal guiding groove for the bolting rod can extend beyond the plane of the slide bolt, thereby substantially preventing a forced opening of the appliance door, as the bolting rod can find support in one or the other housing part on either side of the slide bolt.

According to yet another preferred feature of the invention, the above-mentioned slide bolt has, besides the locking opening destined for receiving the door-locking hook therein, two bolting through-holes for the bolting rod entering one of them, which through-holes are located on both sides of, and equidistantly from, the guiding groove for the bolting rod (or a guiding channel or the like means), when the device is in the open position, and, in the said open position, there remains in the longitudinal groove for the slide bolt, behind the free end of the latter, a free space the length of which, taken along the longitudinal groove axis, amounts to at least half the distance of the centers of the two bolting through-holes from one another. This enables a use of the door-bolting device in doors having a "left-hand"-engaging door-locking hook as well as in those having a "right-hand"-engaging door-locking hook.

One or both of the preferred features that, firstly, the lock-down recess in the slide bolt can have opposite limiting sidewall faces transversely to the longitudinal axis of the slide bolt which faces enclose an obtuse angle, and that, secondly, one end of the signal contactor spring is adapted for engaging the lock-down recess and is of "L"-shape, the horizontal bar of the "L" being devised to fit into the shape of the cross-sectional area of the lock-down recess, enable a particularly smooth actuation of the slide bolt and the door-locking hook guaranteeing at the same time an exactly positioned lock-down of the signal contactor spring while in open position.

BRIEF DESCRIPTION OF THE DRAWINGS

Further objects and their attainment in accordance with the invention will become apparent from the following description, by way of example only, of a preferred embodiment of the novel door-bolting device in connection with the accompanying drawings in which.

DETAILED DESCRIPTION OF THE EMBODIMENT SHOWN IN THE DRAWING

Figure 1:
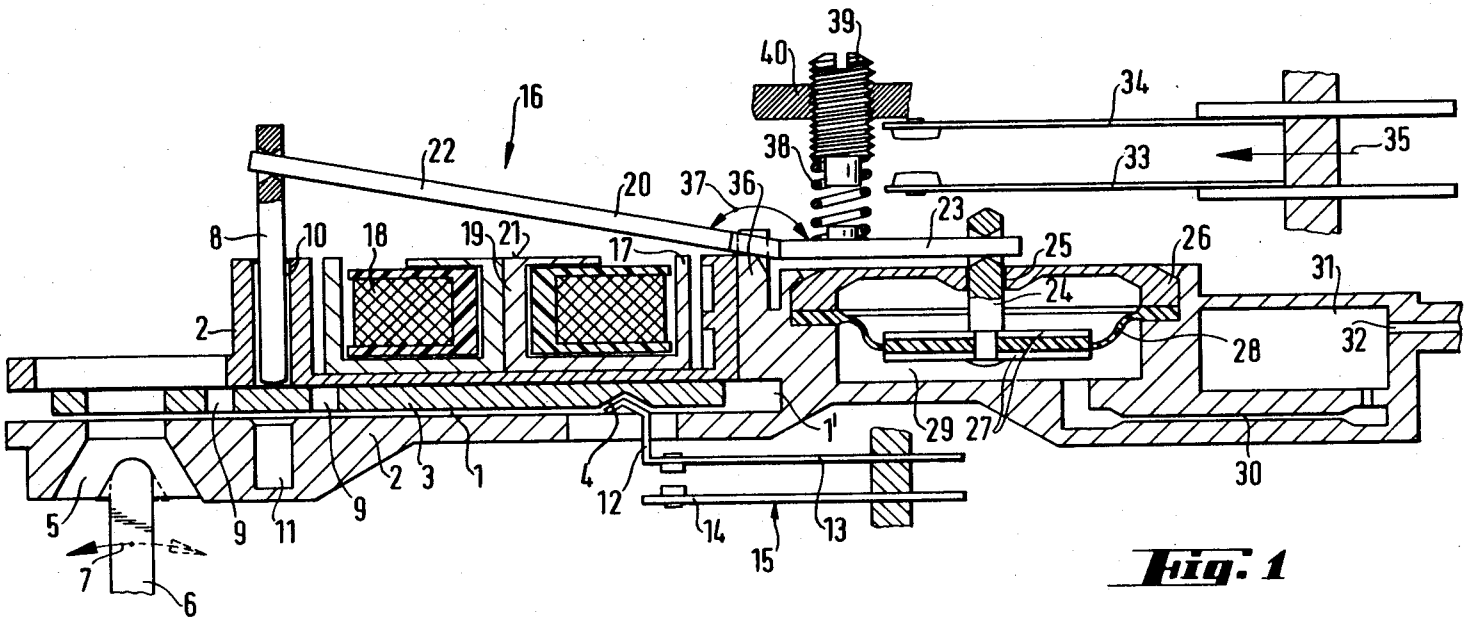
FIG. 1 is a partially sectional top view of the preferred embodiment of the door-bolting device according to the invention with the parts thereof in open position.
Figure 2:
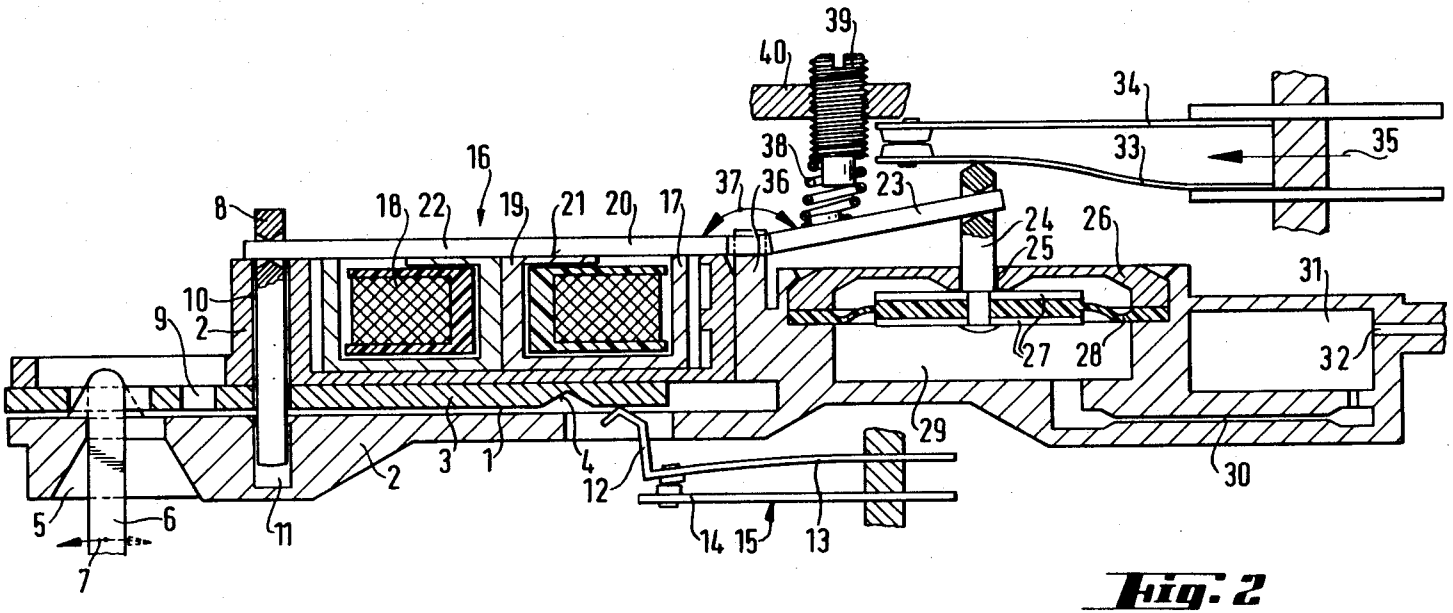
FIG. 2 is a top view analogous with that of FIG. 1, but with the parts of the device in bolted position.

The door-bolting device for electrical appliances, in particular for washing machines, shown in FIGS. 1 and 2, comprises a slide bolt (or bolting slide member) 3 which is supported, for longitudinal displacement, in a longitudinal guiding groove 1 of a housing 2, which groove is provided with several through-holes or openings 5, 9 and with a lock-down recess 4 housing opposite limiting sidewall faces. One of the aforesaid through-holes is a locking opening 5 into which, in the bolted position shown in FIG. 2, there has penetrated a door-locking hook 6 which latter engages with its hook-nose the rear surface of the adjacent wall of the housing 2 and thereby locks the appliance door. Depending on the direction of the locking movement indicated by arrows 7, of the door-locking hook 6, a bolting rod 8 will penetrate into one of the two bolt-receiving through-holes 9 and block longitudinal displacement of the slide bolt 3. In order to permit the use of a door-bolting device with a "left-hand" or a "right-hand" locking movement of the door-locking hook 6 as indicated by the two directions of arrows 7, an extension of the longitudinal guiding groove 1 provides a free end space 1' behind the slide bolt 3 therein when the device is in open position.

In order to provide a safe blocking of the door-bolting device, a transverse guiding groove or channel 10 for guiding the bolting rod 8 has an extension 11, transverse to the longitudinal slide bolt axis, for receiving one end of the bolting rod 8 when the latter is in closing position. In the open position (FIG. 1) of the door-bolting device, the L-shaped free end 12 of a contactor blade spring 13 is in locking engagement with the lock-down recess 4. This spring 13 is one element of a signal contact unit 15, another element thereof being a fixed contactor member 14 which is located opposite to, and extends parallel with, the spring 13. Due to the bolting movement of the slide bolt 3, the free end 12 of the contactor spring 13 is moved out of the lock-down recess 4 and is thereby urged by the adjacent face of the slide bolt 3 in a downward direction toward the fixed contactor 14 against the restoring force of the contactor spring 13 whereby the signal contact in the unit 15 is closed (FIG. 2).

Making or breaking of this signal contact controls the energization of a bolt-actuating relay 16 which is mounted laterally beside the slide bolt 3 on a wall of the housing 2, and which comprises a magnet yoke 17, an electromagnetic coil 18, a core 19 and a double-arm magnet armature lever 20. This magnet armature lever 20 is mounted laterally, besides a pole face 21 of the magnet and has a bolting arm 22 and a main contact arm 23. The free end of the bolting arm 22 is linked articulatedly with an end of the bolting rod 8 protruding from the wall of the housing 2 to one side of the relay, whereby the bolting rod 8 is displaced along the guiding groove 10 by an inwardly directed slewing motion of the magnet armature lever 20 during the bolting operation. The free end of the main contact arm 23 serves as a support for a connecting shaft 24, to one end of which the said main contact arm free end is articulatedly linked; the connecting shaft 24 extends through a lid opening 25 of a pressure chamber lid 26, thereby being guided therein during axial displacement. The other end of the connecting shaft 24 which is located in the interior of a pressure chamber 29 is fastened by means of stiffening bars or plates 27 to a diaphragm 28 which divides the pressure chamber 29 into two subchambers. This pressure chamber 29 is connected via a fluid-conducting channel 30, a pressure-equalizing chamber 31 and a supply duct 32 with, for instance, in the case of a washing machine, the washing drum space. This enables monitoring of the water level in an electrical appliance requiring the presence of water in its interior, as has been explained.

During the bolting operation, the end of the connecting shaft 24 which is remote from the diaphragm 28 exerts pressure increasingly on a main contactor blade spring 33 of an adjusting main contact unit, in which it is located opposite, and extends parallel with, a fixed main contactor member 34, making or breaking contact with the latter member at a main contact point 35. In the bolted position (FIG. 2), this main contactor spring 33 is spatially displaced due to the afore-mentioned exertion of pressure thereon, and makes contact at the main contact point 35, thereby also switching on the electrical appliance which contains the door-bolting device shown in FIGS. 1 and 2.

The magnet armature lever 20 is rotatably supported on a transverse housing wall part 36 which surrounds the electromagnetic coil 18 on the side of the latter remote from and opposite the bolting rod 8. This arrangement, in combination with the obtuse angle 37 enclosed by the bolting arm 22 and the main contact arm 23 of the magnet armature lever 20, provides for a sufficient number of operational movements of the bolting rod 8 and the connecting shaft 24, as well as for a clean magnetic circuit shunt via the magnet yoke 17, the core 19 and the magnet armature lever 20 (FIG. 2).

The main contact arm 23 of the magnet armature lever 20 is biassed, on the side thereof facing away from the pressure chamber 29 and the bolt-actuating relay 16, by a pressure spring 38 which is attached to an adjusting screw 39 lodged in a housing part 40.

I claim:

1. A door-bolting device for electrical apparatus, in particular for the bolting of the door of a washing machine, comprising (a) a housing, (b) a slide bolt having several passage openings and being longitudinally displaceable in a guiding groove in the said housing;

one of said passage openings being a locking opening associated with, and adapted for being entered by, a door-locking hook being connected with the door to be bolted, at least one of the other passage openings being a bolting opening adapted for being penetrated by a bolting rod so as to obstruct the movement of said slide bolt when said door-bolting device is in bolting position;

said slide bolt comprising a lock-down recess being in parallel and staggered relationship with said passage openings of said slide bolt;

(c) a signal contact unit comprising a fixed signal contactor member and a signal contactor spring located opposite said member, said signal contactor spring being adapted for engaging said lock-down recess when said door-bolting device is in open position, and for disengaging said lock-down recess by the bolting movement of said slide bolt, whereby, in the bolting position, said signal contactor unit is adapted to make contact by a spatial displacement of said signal contactor spring;

(d) a bolt-actuating relay comprising a magnet having a pole face and comprising a magnet yoke, an electromagnetic coil, a core and a magnet armature lever being disposed laterally besides said pole face of said magnet and having a bolting arm and a main contact arm, said bolting arm having a free end constituting a bearing for said bolting rod, said rod being displaceably guided in a transverse groove in said housing;

(e) a pressure chamber;

(f) a diaphragm dividing the interior of said chamber;

(g) a pressure chamber lid having a lid opening;

(h) a connecting shaft being axially displaceably guided in, and snugly filling the interior of, said lid opening, said connecting shaft being fastened to said diaphragm, and said main contact arm having a free end constituting a bearing for said connecting shaft;

(i) a pressure-equalizing chamber;

(j) a fluid-conducting channel connecting said pressure-equalizing chamber with said pressure chamber, and a supply duct adapted for feeding a fluid medium from the outside into said pressure-equalizing chamber; and (k) an adjusting contactor unit comprising a fixed adjusting contactor member and an adjusting contactor spring adapted for making electrical contact with said adjusting contactor member at a main contact point therebetween, said connecting shaft having an end facing away from said diaphragm and increasingly urging said adjusting contactor spring against the bias thereof, into contact at said main contact point.

2. The device of claim 1, wherein said housing comprises a housing part surrounding said magnet core and said magnet yoke on the sides thereof opposite said bolting rod, and wherein said magnet armature lever is rotatably supported on said housing part.

3. The device of claim 2, wherein the two arms of said magnet armature lever enclose an obtuse angle.

4. The device of claim 1, wherein the directions of movement of said magnet armature lever, said bolting rod, said slide bolt, said connecting shaft and said two contactor springs extend in a common plane.

5. The device of claim 1, wherein the longitudinal axes of said slide bolt, said two contactor springs, said diaphragm and said magnet armature lever all extend substantially parallel with each other.

6. The device of claim 1, wherein said adjusting contactor unit comprises a pressure spring, said pressure spring exerting increasingly, during the bolting operation, pressure on said main contact arm of said magnet armature lever, thereby opposing a pivotal movement of said lever.

7. The device of claim 6, wherein said housing comprises a second housing part and a screw therein bearing said pressure spring and being adapted for adjusting the restoring force thereof acting upon said main contact arm.

8. The device of claim 1, wherein said diaphragm comprises, located in the radially internal region thereof, stiffening bars being attachable to said connecting shaft.

9. The device of claim 1, wherein the transverse groove for said bolting rod extends beyond the plane of said slide bolt.

10. The device of claim 1, wherein said slide bolt has, besides said locking opening destined for receiving said door-locking hook therein, two bolting openings for receiving said bolting rod, said two bolting openings being located, when said device is in the open position, on both sides of, and equidistantly from, said transverse groove for the bolting rod, and wherein, in said open position, there remains in said groove, behind the free end of said slide bolt, a free space the length of which, taken along the longitudinal axis of said groove, amounts to at least half the distance of the centers of said two bolting openings from one another.

11. The device of claim 1, wherein said lock-down recess in said slide bolt has opposite limiting sidewall faces extending transversely to the longitudinal axis of said slide bolt and enclosing an obtuse angle.

12. The device of claim 11, wherein one end of said signal contactor spring is adapted for engaging said lock-down recess and has the shape of an "L" the horizontal bar of which is adapted for fitting into the shape of the cross-sectional area of said lock-down recess.

* * * * *